US008026686B2

(12) United States Patent
Wenzel et al.

(10) Patent No.: US 8,026,686 B2
(45) Date of Patent: Sep. 27, 2011

(54) DEVICE FOR CONTROLLING THE MOVEMENT OF A PLURALITY OF MOVABLE FURNITURE PARTS AND METHOD FOR CONFIGURATION OF A DEVICE SUCH AS THIS, AND PIECE OF FURNITURE

(75) Inventors: Holger Wenzel, Lindau (DE); Helmut Wetschko, Klaus-Weiler (AT); Jürgen Zipp, Braunfels (DE); Carmelo Gutierrez, Ehringshausen (DE); Steffen Medebach, Wetzlar (DE)

(73) Assignees: Grass GmbH, Hochst (AT); Küster Automotive Door Systems GmbH, Ehringshausen (DE)

( * ) Notice: Subject to any disclaimer, the term of this patent is extended or adjusted under 35 U.S.C. 154(b) by 418 days.

(21) Appl. No.: 12/244,155

(22) Filed: Oct. 2, 2008

(65) Prior Publication Data

US 2009/0134753 A1 May 28, 2009

Related U.S. Application Data

(63) Continuation of application No. PCT/EP2007/003031, filed on Apr. 4, 2007.

(30) Foreign Application Priority Data

Apr. 4, 2006 (DE) ..... 10 2006 016 102
Apr. 4, 2006 (DE) ..... 20 2006 005 581 U

(51) Int. Cl.
*G05B 5/00* (2006.01)

(52) U.S. Cl. ..... 318/468; 318/466; 318/450

(58) Field of Classification Search ..... 318/468, 318/466, 450, 646, 9, 568.13, 319.1, 319.5
See application file for complete search history.

(56) References Cited

U.S. PATENT DOCUMENTS

| | | | | |
|---|---|---|---|---|
| 6,685,288 | B1 | 2/2004 | MacMillan | |
| 2006/0261769 | A1* | 11/2006 | Rees | 318/450 |

FOREIGN PATENT DOCUMENTS

| | | | |
|---|---|---|---|
| AT | 007 723 | U1 | 6/2005 |
| DE | 88 02 343 | | 5/1988 |
| DE | 101 05 756 | A1 | 8/2001 |
| DE | 203 08 256 | U1 | 6/2004 |
| DE | 20 2004 007 170 | U1 | 9/2004 |
| DE | 20 2004 016 265 | U1 | 3/2005 |
| DE | 20 2005 013 128 | U1 | 12/2005 |
| DE | 10 2004 045 568 | A1 | 3/2006 |
| DE | 20 2005 018 353 | U1 | 3/2006 |
| DE | 10 2004 045 567 | A1 | 4/2006 |
| DE | 20 2005 020 203 | U1 | 4/2006 |
| DE | 20 2005 006 945 | U1 | 6/2006 |

(Continued)

*Primary Examiner* — Karen Masih
(74) *Attorney, Agent, or Firm* — Burr & Brown

(57) ABSTRACT

A method for configuration of a device for controlling the movement of a plurality of movable furniture parts which can be moved in a driven manner relative to a stationary furniture part by means of a drive unit and a monitoring unit for monitoring the movement of the movable furniture parts. In order to match the movement of the movable furniture parts, at least an inner furniture part is associated with an outer furniture part such that, when a configuration mode is activated, the association of the at least one inner furniture part with the outer furniture part is created by a sequence of opening and/or closing movements of the movable furniture parts that are associated with one another.

12 Claims, 1 Drawing Sheet

FOREIGN PATENT DOCUMENTS

| | | | |
|---|---|---|---|
| DE | 20 2006 002 103 | U1 | 8/2006 |
| DE | 20 2006 012 976 | U1 | 12/2006 |
| DE | 20 2006 012 656 | U1 | 2/2007 |
| DE | 20 2005 021 123 | U1 | 3/2007 |
| EP | 1 323 363 | A1 | 7/2003 |
| EP | 1 323 364 | A1 | 7/2003 |
| EP | 1 374 732 | A1 | 1/2004 |
| WO | 2004/100717 | A1 | 11/2004 |
| WO | 2004/100718 | A1 | 11/2004 |
| WO | 2005/058092 | A1 | 6/2005 |

* cited by examiner

DEVICE FOR CONTROLLING THE MOVEMENT OF A PLURALITY OF MOVABLE FURNITURE PARTS AND METHOD FOR CONFIGURATION OF A DEVICE SUCH AS THIS, AND PIECE OF FURNITURE

CROSS REFERENCE TO RELATED APPLICATIONS

This application is a continuation of International Application No. PCT/EP2007/003031, filed Apr. 4, 2007, which designated the United States, and claims the benefit under 35 USC §119(a)-(d) of German Application Nos. 20 2006 005 581.9 and 10 2006 016 102.5 both filed Apr. 4, 2006, the entireties of which are incorporated herein by reference.

FIELD OF THE INVENTION

The invention relates to a method of controlling the movement between at least one inner furniture part and an associated outer furniture part, a device for carrying out the method, and a piece of furniture including the device.

BACKGROUND OF THE INVENTION

Devices for controlling the movements of a plurality of furniture parts which can be moved with respect to a stationary furniture part are known from the prior art. The movable furniture parts can be moved in a driven manner with the aid of a monitoring unit for monitoring the movement of the movable furniture parts, and a drive unit.

One particular requirement with regard to movement monitoring occurs in the case of pieces of furniture which have inner furniture parts in which, when relevant movable furniture parts are in the closed position, some are at least partially covered on the outside by an outer furniture part. In particular, a front part of the movable outer furniture part covers a front part of the movable inner furniture part in the closed state with respect to the stationary furniture part.

SUMMARY OF THE INVENTION

The object of the invention is to provide a simple and comparatively uncomplicated association with respect to influencing the movement between at least one inner furniture part and an associated outer furniture part.

First of all, the invention is based on a method for configuration of a device for controlling the movement of a plurality of movable furniture parts which can be moved in a driven manner relative to a stationary furniture part by means of a drive unit via a monitoring unit for monitoring the movement of the movable furniture parts, with a front part of a movable outer furniture part covering a front part of a movable inner furniture part at least partially on the outside at least when the relevant furniture parts are in the closed state with respect to the stationary furniture part. One major aspect of the invention is that in order to match the movement of the movable furniture parts, at least an inner furniture part is associated with an associated outer furniture part such that, when a configuration mode is activated, the association of the at least one inner furniture part with the outer furniture part is created by a sequence of opening and/or closing movements of the movable furniture parts which can be associated with one another. This allows the device for controlling the movement of a plurality of movable furniture parts to be configured in a simple manner and without any specific knowledge required of the operator. All that is necessary is first of all to ensure that a configuration mode is activated, in which case the configuration of the device is possible only when the configuration mode is activated. There are a multiplicity of feasible different possible ways to enter the activated configuration mode.

Once the configuration mode has been activated, a person, in particular the end user himself, can associate at least one inner furniture part with an associated outer furniture part. All that is required for association is a sequence of movements of the relevant movable furniture parts, in particular by an opening and closing movement of the relevant movable furniture parts which can be associated with one another. The movements may be the standard movements provided during normal operation and/or movements of the relevant movable furniture parts which differ from them, and which are used, for example, in particular only for configuration.

Inner and/or outer furniture parts may be drawers, doors, hatches, folding elements, tablar panels, wire baskets, pharmacy cabinets, carousels or the like.

Advantageously, no further additional devices or specific complex configuration steps are required which would otherwise complicate the association process and would increase the effort required to set up appropriate precautions.

It is also possible that the association is created by a sequence of initiation commands for the opening and/or closing movements of the movable furniture parts which can be associated with one another. This advantageously allows the association of the at least one inner furniture part with the associated outer furniture part to be shortened and in particular to be carried out in a simpler manner. For example, it may just be sufficient to achieve a unique association between the relevant movable furniture parts to use just one input command for an opening and/or closing movement or a sequence of a plurality of input commands for an opening and/or closing movement of the movable furniture parts which can be associated with one another. This procedure is particularly advantageous for the situation which occurs frequently when a separate initiation command is provided for each opening and closing movement of a movable furniture part. However, it is also feasible for an opening and/or closing movement and at least one further opening and/or closing movement to be coupled to one initiation command.

It is preferable if after an opening movement for the outer furniture part, an opening movement is first of all carried out for the inner furniture part, followed by a closing movement for the inner furniture part, and then a closing movement for the outer furniture part, with the movement controlling device being provided with information relating to the association of the movable furniture parts. This procedure relates in particular to the comparatively simple situation in which one and only one inner furniture part is associated with one outer furniture part. The configuration of the sequence of movements to be carried out in this case is oriented on the circumstances to be considered for a person, for inner and outer furniture parts which can be moved only manually. In these situations, for physical and spatial reasons, the outer furniture part must be at least partially open first of all when the furniture parts are closed, before the associated inner furniture part can be gripped and opened. Conversely, when the inner and outer furniture parts are open, the inner furniture part must be closed again first in order that the outer furniture part can reach a closed position again without any problems. The movement sequence which is predetermined in practice in this way for inner and outer furniture parts which cannot be moved by a drive unit is advantageously also used as the basis for the configuration process according to the invention. This procedure results in the configuration process for systems with a drive unit being particularly uncomplicated. Even laypersons can carry out the configuration process themselves without any prejudice or skepticism relating to unusual configuration modalities.

Particularly when a plurality of inner furniture parts and an associated outer furniture part are present, the invention allows alternative procedures. It is proposed that, after an opening movement for the outer furniture part, an opening movement is first of all carried out for one inner furniture part of a plurality of inner furniture parts, followed by a closing movement, after which a corresponding procedure is followed for each further inner furniture part and then a closing movement is carried out for the outer furniture part, with the movement controlling device being provided with information relating to the association of the movable furniture parts. The proposed procedure is particularly time-saving since the outer furniture part need be opened once at the start of the sequence of the plurality of opening and closing movements for the configuration of the inner furniture parts and must be moved to the closed position once before the end of the configuration process. The sequence in which the plurality of inner furniture parts are opened and closed again successively is irrelevant to the association process. For example, it is possible to start with the opening and/or closing movement with the uppermost of all the inner furniture parts or the lowermost of the inner furniture parts, or a plurality of inner furniture parts can be moved successively in an arbitrarily defined manner.

It is also advantageous that when the configuration mode is activated, a plurality of respectively separate associations are created between at least one inner furniture part and an associated outer furniture part. The association of the respectively associated inner furniture parts can thus also be carried out for a plurality of outer furniture parts which in particular belong to one device for controlling movement, when the configuration mode is activated. This may be advantageous in particular for relatively large systems and/or for example for rooms in which there are a plurality of outer furniture parts.

It is also possible that the configuration mode is activated and/or deactivated via an externally applied input command. For activation and the deactivation of the configuration mode, it is particularly advantageous if it is possible for one person to deliberately start the configuration mode and to end it again after completion. This ensures that the person who is carrying out the configuration process always clearly knows when the configuration mode is active or has been switched to passive, and defines its start and end. In particular, this makes it possible to preclude an incorrect configuration resulting from a configuration mode having been activated and/or deactivated inadvertently or accidentally.

In addition, it is advantageous that for a successful association in the activated configuration mode after the initiation command for the opening and/or closing movement for a movable furniture part, the subsequent movement is interrupted or alternatively can be carried out to the end. This allows the configuration process to be optionally completed by means of movement processes of the movable furniture parts which are carried out as standard, as a result of which a person need himself intervene only relatively little in the procedure, that is to say a minimal amount of effort is required. Alternatively, the sequence of the movement processes can be controlled individually, for example by acting on the furniture parts and their movement in order in particular to suppress or to terminate a movement which has been initiated and may otherwise have been carried out completely, thus allowing time to be saved, for example allowing the next configuration step and possibly the configuration end to be reached more quickly.

This can be particularly advantageous if a multiplicity of corresponding furniture parts can be associated by the sequence of the opening and/or closing movements. Irrespective of the chosen procedure, the system identifies the initiation commands and the closing and/or opening movements initiated in the process, and registers these for the association process, irrespective of when a movement has only been initiated and/or has been carried out only incompletely, or whether it has been carried out completely.

The invention also relates to a device for controlling the movement of a plurality of movable furniture parts which can be moved in a driven manner relative to a stationary furniture part by means of a drive unit via a monitoring unit for monitoring the movement of the movable furniture parts, with a front part of a movable outer furniture part at least partially covering a front part of a movable inner furniture part on the outside at least when the relevant furniture parts are in the completely closed state with respect to the stationary furniture part. The invention extends in particular to a device by means of which one of the above-mentioned methods can be carried out. One major aspect in this case is that the monitoring unit is designed such that, in order to match the movement of the movable furniture parts in an activated configuration mode, an association is created between at least one inner furniture part and an associated outer furniture part by means of a sequence of opening and/or closing movements of the movable furniture parts which can be associated with one another. The device is therefore designed in order to achieve the advantages discussed above. The configuration process can therefore be carried out in a particularly simple form and possibly without any additional devices or with little effort. All that is required is to provide means for activation and/or deactivation of the configuration mode, in which case the device can be configured only when the configuration mode is activated. The configuration mode can be selected via a multiplicity of different activation and deactivation means.

The monitoring unit is preferably designed such that the association can be defined by a sequence of initiation commands for opening and/or closing movements of the movable furniture parts which can be associated with one another. This advantageously allows the configuration process to be carried out without any specific knowledge required by the operator, or by the furniture parts themselves.

A further advantage of an association of inner and outer furniture parts can also be seen in that the position of two mutually associated furniture parts can be identified via the monitoring unit, by which means the movement process can advantageously be matched and a collision or risk of trapping between the associated furniture parts can be avoided.

It is also advantageous that the monitoring unit is designed to define the association in that, after an opening movement for the outer furniture part, an opening movement for an inner furniture part is carried out first of all, followed by a closing movement for the inner furniture part and then a closing movement for the outer furniture part.

Furthermore, it is proposed that the monitoring unit is designed to define the association in that, after an opening movement for the outer furniture part, an opening movement for one inner furniture part of a plurality of inner furniture parts is carried out first of all, followed by a closing movement for that inner furniture part, followed by a corresponding procedure being adopted for each further inner furniture part, followed by a closing movement for the outer furniture part. In particular, the monitoring unit can advantageously be used for outer furniture parts which are associated with a plurality of inner furniture parts, in particular the plurality of inner furniture parts being covered on the outside by the outer furniture part, at least when all the inner furniture parts and the single outer furniture part are covered by the front face of the outer furniture part in the closed position.

The invention also relates to a piece of furniture having a plurality of movable furniture parts which can be moved in a driven manner relative to a stationary furniture part by means of a drive unit via a monitoring unit for monitoring the movement of the movable furniture parts, with a front part of a movable outer furniture part at least partially covering a front part of a movable inner furniture part on the outside at least when the relevant furniture parts are in the closed state with respect to the stationary furniture part. The piece of furniture is distinguished in that one of the devices mentioned above is provided. This allows the advantages which have already been explained above to be achieved for a correspondingly equipped piece of furniture.

BRIEF DESCRIPTION OF THE DRAWING

A highly schematically illustrated exemplary embodiment of the invention is illustrated in the single FIGURE and will be described in more detail, with further advantages and details.

DETAILED DESCRIPTION OF THE INVENTION

Figure 1:
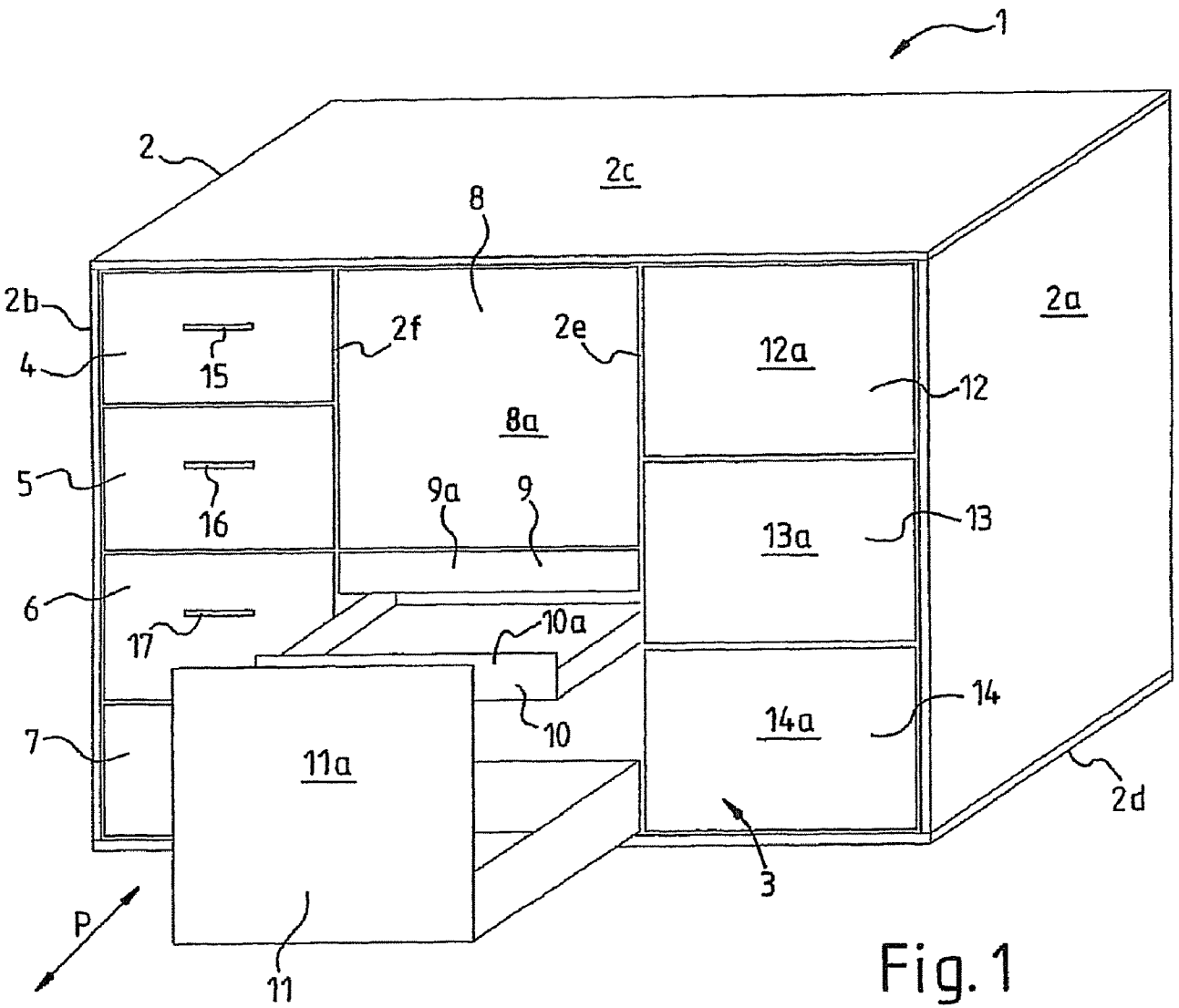
FIG. 1 is a schematic showing a perspective front view of a piece of furniture.

FIG. 1 shows a piece of furniture 1 with a stationary furniture part or a furniture housing 2 and furniture drawer units 3, which are guided such that they can move thereon and have a plurality of drawers 4-14. A front part 11*a* of an outer drawer 11 can cover the front part 9*a* of an inner drawer 9 and the front part 10*a* of an inner drawer 10. When the furniture drawer units 3 are in the closed state, the piece of furniture 1 has a cuboid shape. The furniture housing 2 comprises two outer side walls 2*a* and 2*b*, an upper part 2*c*, a bottom part 2*d*, as well as a rear wall (not shown in FIG. 1). The furniture housing 2 also has inner walls 2*e* and 2*f* which run parallel to the side walls 2*a*, 2*b* in the interior of the furniture carcass.

The furniture drawer units 3 are held such that they can be moved on the side walls 2*a*, 2*b* and the inner walls 2*e*, 2*f* in the furniture housing 2 via pull-out guides (not shown), for example by known full drawer extensions. The furniture drawer units 3 can be pushed in and pulled out relative to the furniture housing 2 as indicated by the double-headed arrow P. The drawers 4-9 and 12-14 are each located in the closed position while, in contrast, the inner drawer 10 is approximately half open and the outer drawer 11 is entirely open with respect to the furniture housing 2.

Looking at the front of the piece of furniture 1 as shown in FIG. 1, the arrangement of the drawers comprises three columns, each having a plurality of drawers positioned one above the other. The left-hand column, seen from the front, comprises the identical drawers 4-7 between the side wall 2*b* and the inner wall 2*f*, the center column comprises the drawers 8-11 between the inner walls 2*e* and 2*f*, and the right-hand column comprises the drawers 12-14 between the inner wall 2*e* and the side wall 2*a*.

A device which is not illustrated in FIG. 1, for example corresponding to the device described in WO 2006/029 894 A1 for controlling the movement of the furniture drawer units 3 is provided for driven movement in particular of each furniture drawer unit 4-14, with the driven movement being provided by a drive unit and a monitoring unit for monitoring the movement of the furniture drawer units 3. Connecting lines or the like for supplying the device for influencing movement are likewise not illustrated in FIG. 1.

The drawers 4-6 are provided on their drawer fronts with a respective handle element 15-17, and the drawer 7 is provided with a further handle element, which cannot be seen, in order to allow the relevant drawer to be gripped manually and in particular to allow the drawer to be pulled. Thus, in principle, it is possible for the drawers 4-7 to be moved not just driven by the drive unit but also just by being operated manually. It is also feasible that the drawers 4-7 can be moved driven by the drive unit and manually in order, for example when they are being moved manually by someone, for this movement to be assisted by the drive unit, in particular during opening.

The other drawers can be moved in particular by the drive unit, in which case it is feasible for a drawer which can be moved in a driven manner also to be moved manually, for example if an electrical supply is interrupted. The drive unit may be designed in many ways and may operate by electrical means, for example with the aid of an electric motor or non-electrically with mechanical means, or may operate with a combination of these means. The opening and/or closing movement may be carried out entirely or partially in a driven manner, for example if ejection means are provided for ejection of the movable furniture part from a closed position to an at least partially open position.

In the case of the piece of furniture 1, the control plane is formed when the closed drawer fronts ideally lie on a plane, although the invention also covers pieces of furniture whose control faces or front faces lie on two or more different planes when the movable furniture parts are closed, for example in the case of arrangements with closed front faces which are positioned at right angles or opposite to one another. This also covers arrangements with folding hatches or doors which are positioned one above the other, for example in an upper cabinet and a lower cabinet, with at least one folding shutter or door being movable upwards, and another being movable downwards. This makes it possible to avoid the risk of trapping occurring during such movements.

The drawers 8-14 are equipped on the front parts 8*a*-14*a* without a contour and/or without a handle element or some other aid for pulling on the relevant furniture part. The drawers 4-14 may be provided with or without, for example, in particular an injector or touch-latch functionality. For example, the drawers 8-14 can be initiated, to be precise opened or closed, for example by tapping on the front face of a drawer.

Furthermore, the monitoring unit is designed such that no collision between the driven movement of one of the drawers 9-11 can take place for the inner drawers 9, 10 and the outer drawer 11. Assuming that only driven movements of all the drawers 4-14 are desired and, for example, this results in a state as shown in FIG. 1 and the intention is that the outer drawer 11, which is illustrated in the entirely open position, is intended to be closed in a driven manner, various options can be provided in order to avoid collisions. For example, the inner drawer 10 which is illustrated half-open must first of all be completely closed before the outer drawer 11 is moved from the entirely open position to the entirely closed position. This can be done, for example in such a way that, when a closing command is issued, for example by a person for the outer drawer 11, the system and the monitoring unit monitor that the inner drawer 10 is first of all moved to the closed position, after which the outer drawer 11 is closed completely in an uninterrupted movement.

When the outer drawer 11 is being closed, it may also be possible for all the associated inner drawers 9 and 10 that are in the open state to be closed at the same time with the outer drawer 11, with this being done in such a manner that no collision or risk of trapping occurs.

Movement states in which a collision between two simultaneously movable furniture parts could occur are precluded from the start by the monitoring unit, in particular by means of superordinate stored monitoring mechanisms. Thus, in the example shown in FIG. 1, opposite movements of the drawers 9 and 11 as well as 10 and 11 taking place simultaneously are at least impossible in such a way that the front part 11*a* will collide with one of the front parts 9*a* or 10*a*.

More complex matching processes for movement procedures of drawers 9, 10 and 11 may also be stored in the monitoring unit. For example, if the outer drawer 11 is open and the inner drawers 9 and 10 are closed. The inner drawer is not opened in a driven manner and is still in motion, that is to say it has not yet, for example, been opened completely. During this process, an input command is issued to close the outer drawer 11. A possible risk of collision or crushing would now occur if the inner drawer 10 and the outer drawer 11 were to move in opposite directions toward one another without a monitoring mechanism. Various procedures are predetermined in order to make it possible to avoid this. For example: 1) both drawers 10 and 11 stop and remain stationary before a collision or risk of crushing occurs; 2) inner drawer 10 stops and returns to the closed position, and the outer drawer moves in a driven manner to the closed position; and 3) outer drawer 11 stops and returns to the open position and the inner drawer 10 opens further. In the case of the last option, the inner drawer 10 can stop briefly during the driven movement to the open position and can then move further in the same direction, or at least can move further in the decelerated manner, or can move in a driven manner without interruption or without deceleration.

By way of example, an intelligent solution can define a group of associated drawers for each individual drawer, and this can likewise be stored in the monitoring unit. For example, the drawers 5, 6, 7, 8, 13 and 14 could additionally be associated with the outer drawer 11, for example, for which, as explained above, monitoring mechanisms are applicable in order to avoid collisions with the drawers 9 and 10.

In principle, the monitoring unit can be designed in such a way that it is also possible to take account of movable furniture parts of other stationary furniture housings in the association for a furniture part which can be moved in a driven manner and is being considered, that is to say also opposite furniture parts or furniture parts arranged at right angles, such as in drawers, hatches or doors. In this case as well, superordinate monitoring mechanisms may be applicable in order to avoid collisions, that is to say relative velocities for these furniture parts need not be defined or may be defined only for restricted permissible movement phases of the entire possible movement.

The exemplary embodiment in FIG. 1 shows a piece of furniture with a plurality of drawers. However, the invention also relates to other pieces of furniture with outer and inner furniture parts which can be moved in a driven manner and which, for example, may be in the form of doors, hatches, tablar panels, wire baskets, pharmacy cabinets, rotating racks, carousels or the like.

LIST OF REFERENCE SYMBOLS

1 Piece of furniture
2 Furniture housing
2*a* Side wall
2*b* Side wall
2*c* Upper part
2*d* Bottom part
2*e* Inner wall
2*f* Inner wall
3 Furniture drawer unit
4 Drawer
5 Drawer
6 Drawer
7 Drawer
8 Drawer
8*a* Front part
9 Inner drawer
9*a* Front part
10 Inner drawer
10*a* Front part
11 Outer drawer
11*a* Front part
12 Drawer
12*a* Front part
13 Drawer
13*a* Front part
14 Drawer
14*a* Front part
15 Handle element
16 Handle element
17 Handle element

We claim:

1. A method for configuring a device for controlling the movement of a plurality of movable furniture parts which can be moved in a driven manner relative to a stationary furniture part, the device including a drive unit for moving the movable furniture parts, and a monitoring unit for monitoring the movement of the movable furniture parts, with a front part of a movable outer furniture part covering a front part of a movable inner furniture part at least partially on the outside at least when the furniture parts are in a closed state with respect to the stationary furniture part, the method comprising activating a configuration mode to achieve association of at least one inner furniture part with an outer furniture part by performing a sequence of opening and/or closing movements of the thus associated movable furniture parts in order to match the movement of the movable furniture parts.

2. The method as claimed in claim 1, wherein the association is created by a sequence of initiation commands for the opening and/or closing movements of the movable furniture parts that are associated with one another.

3. The method as claimed in claim 1, wherein after an opening movement for the outer furniture part, an opening movement is first of all carried out for the inner furniture part, followed by a closing movement for the inner furniture part, and then a closing movement for the outer furniture part, and said method further comprises providing the device with information relating to the association of the movable furniture parts.

4. The method as claimed in claim 1, wherein after an opening movement for the outer furniture part, an opening movement is first of all carried out for one inner furniture part of a plurality of inner furniture parts, followed by a closing movement, after which a corresponding procedure is followed for each further inner furniture part and then a closing movement is carried out for the outer furniture part, and said method further comprises providing the device with information relating to the association of the movable furniture parts.

5. The method as claimed in claim 1, wherein when the configuration mode is activated, a plurality of respectively separate associations are created between at least one inner furniture part and an associated outer furniture part.

6. The method as claimed in claim 1, wherein the configuration mode is activated and/or deactivated via an externally applied input command.

7. The method as claimed in claim 2, wherein for a successful association in the activated configuration mode after the initiation command for the opening and/or closing movement for a movable furniture part, subsequent movement is interrupted or alternatively can be carried out to the end.

8. A device for controlling the movement of a plurality of movable furniture parts which can be moved in a driven manner relative to a stationary furniture part, comprising a drive unit for moving the movable furniture parts, and a monitoring unit for monitoring the movement of the movable furniture parts, with a front part of a movable outer furniture part at least partially covering a front part of a movable inner furniture part on the outside at least when the furniture parts are in a completely closed state with respect to the stationary furniture part, wherein an association is created between at least one inner furniture part and an outer furniture part by means of a sequence of opening and/or closing movements of the movable furniture parts that are associated with one another such that the monitoring unit can match the movement of the movable furniture parts in an activated configuration mode.

9. The device as claimed in claim 8, wherein the association is defined by a sequence of initiation commands for opening and/or closing movements of the movable furniture parts that are associated with one another.

10. The device as claimed in claim 8, wherein the association is defined such that, after an opening movement for the outer furniture part, an opening movement for an inner furniture part is carried out first of all, followed by a closing movement for the inner furniture part and then a closing movement for the outer furniture part.

11. The device as claimed in claim 8, wherein the association is defined such that, after an opening movement for the outer furniture part, an opening movement for one inner furniture part of a plurality of inner furniture parts is carried out first of all, followed by a closing movement for that inner furniture part, followed by a corresponding procedure being adopted for each further inner furniture part, followed by a closing movement for the outer furniture part.

12. A piece of furniture comprising the device as claimed in claim 8.

* * * * *